US007038671B2

(12) United States Patent
Willis et al.

(10) Patent No.: US 7,038,671 B2
(45) Date of Patent: May 2, 2006

(54) DIGITALLY DRIVING PIXELS FROM PULSE WIDTH MODULATED WAVEFORMS

(75) Inventors: Thomas E. Willis, Mountain View, CA (US); Michael O'Connor, Cupertino, CA (US)

(73) Assignee: Intel Corporation, Santa Clara, CA (US)

( * ) Notice: Subject to any disclaimer, the term of this patent is extended or adjusted under 35 U.S.C. 154(b) by 513 days.

(21) Appl. No.: 10/081,751

(22) Filed: Feb. 22, 2002

(65) Prior Publication Data

US 2003/0160804 A1 Aug. 28, 2003

(51) Int. Cl.
*G09G 5/00* (2006.01)

(52) U.S. Cl. ..... 345/205; 345/87; 345/208; 345/690

(58) Field of Classification Search ..... 345/87–90, 345/98–100, 205, 690, 691, 208, 211
See application file for complete search history.

(56) References Cited

U.S. PATENT DOCUMENTS 5,977,942 A * 11/1999 Walker et al. ..... 345/97
6,072,452 A * 6/2000 Worley et al. ..... 345/89
6,137,462 A * 10/2000 Kim ..... 345/94
6,373,478 B1 * 4/2002 Steffensmeier ..... 345/204
6,590,549 B1 * 7/2003 Marshall ..... 345/84
2002/0063728 A1 * 5/2002 Stevens ..... 345/690

* cited by examiner

*Primary Examiner*—Henry N. Tran
(74) *Attorney, Agent, or Firm*—Trop, Pruner & Hu, P.C.

(57) ABSTRACT

Pulse-width modulation may be utilized to drive one or more display elements of a display (e.g. pixels of a liquid crystal display system) comprising a controller that supplies digital information including global and local digital information to a respective signal generator associated with each display element operably coupled to the controller for receiving the digital information. In one embodiment, a spatial light modulator includes a respective local drive circuit associated with each pixel of a pixel array, and a global drive circuit operably coupled to the pixel array for digitally driving the pixel electrodes. Each local drive circuit may include a pixel logic, a digital storage, and pulse-width modulation circuitry. The global drive circuit may include a control logic, and a memory storing global digital information indicative of a common reference (e.g., a count value) and local digital information (e.g., a pixel value) indicative of an optical output from each pixel. Based on the global and local digital information, the pixel logic and control logic may cooperatively determine a transition separating a first pulse interval and a second pulse interval in a modulated signal generated for each pixel.

30 Claims, 6 Drawing Sheets

DIGITALLY DRIVING PIXELS FROM PULSE WIDTH MODULATED WAVEFORMS

BACKGROUND

The present invention relates generally to displays, and more particularly, using pulse-width modulation to drive one or more display elements of an electro-optical display, for example, to digitally drive pixels from pulse width modulated waveforms in a liquid crystal display, such as a spatial light modulator with digital storage.

Pulse-width modulation (PWM) has been employed to drive liquid crystal displays (displays). A pulse-width modulation scheme may control displays, including emissive and non-emissive displays, which may generally comprise multiple display elements. In order to control such displays, the current, voltage or any other physical parameter that may be driving the display element may be manipulated. When appropriately driven, these display elements, such as pixels, normally develop light that can be perceived by viewers.

In an emissive display example, to drive a display (e.g., a display matrix having a set of pixels), electrical current is typically passed through selected pixels by applying a voltage to the corresponding rows and columns from drivers coupled to each row and column in some display architectures. An external controller circuit typically provides the necessary input power and data signal. The data signal is generally supplied to the column lines and synchronized to the scanning of the row lines. When a particular row is selected, the column lines determine which pixels are lit. An output in the form of an image is thus displayed on the display by successively scanning through all the rows in a frame.

For instance, a spatial light modulator (SLM) uses an electric field to modulate the orientation of a liquid crystal (LC) material. By the selective modulation of the liquid crystal material, an electronic display may be produced. The orientation of the LC material affects the intensity of light going through the LC material. Therefore, by sandwiching the LC material between an electrode and a transparent top plate, the optical properties of the LC material may be modulated. In operation, by changing the voltage applied across the electrode and the transparent top plate, the LC material may produce different levels of intensity on the optical output, altering an image produced on a screen.

Typically, a spatial light modulator (SLM) is a display device where a liquid crystal material (LC) is driven by circuitry located at each pixel. For example, when the LC material is driven, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion. In this case, it is not possible to directly drive the LC material with the digital information, i.e., there needs to be some conversion to an analog form that the LC material can use.

Pulse-width modulation (PWM) may be utilized for driving an SLM device. However, several conventional PWM schemes add up non-overlapping waveforms to build a PWM waveform. Unfortunately, these conventional ways of driving displays using a typical PWM scheme may not be adequate, as multiple edges may get generated in the PWM waveform. Using this approach, for example, the LC material may not be driven by a signal that is a function of the desired color value. Therefore, such a multi-edged PWM waveform that draws upon multiple non-overlapping pulses to build the PWM waveform for driving a display device or display system architecture may not precisely control the LC material being driven. Furthermore, this type of driving control that simply uses a fixed waveform may not be easily tuned to a particular LC material.

Thus, better ways are desired to drive display elements in displays, especially in digital pixel architectures.

DETAILED DESCRIPTION

Figure 1:
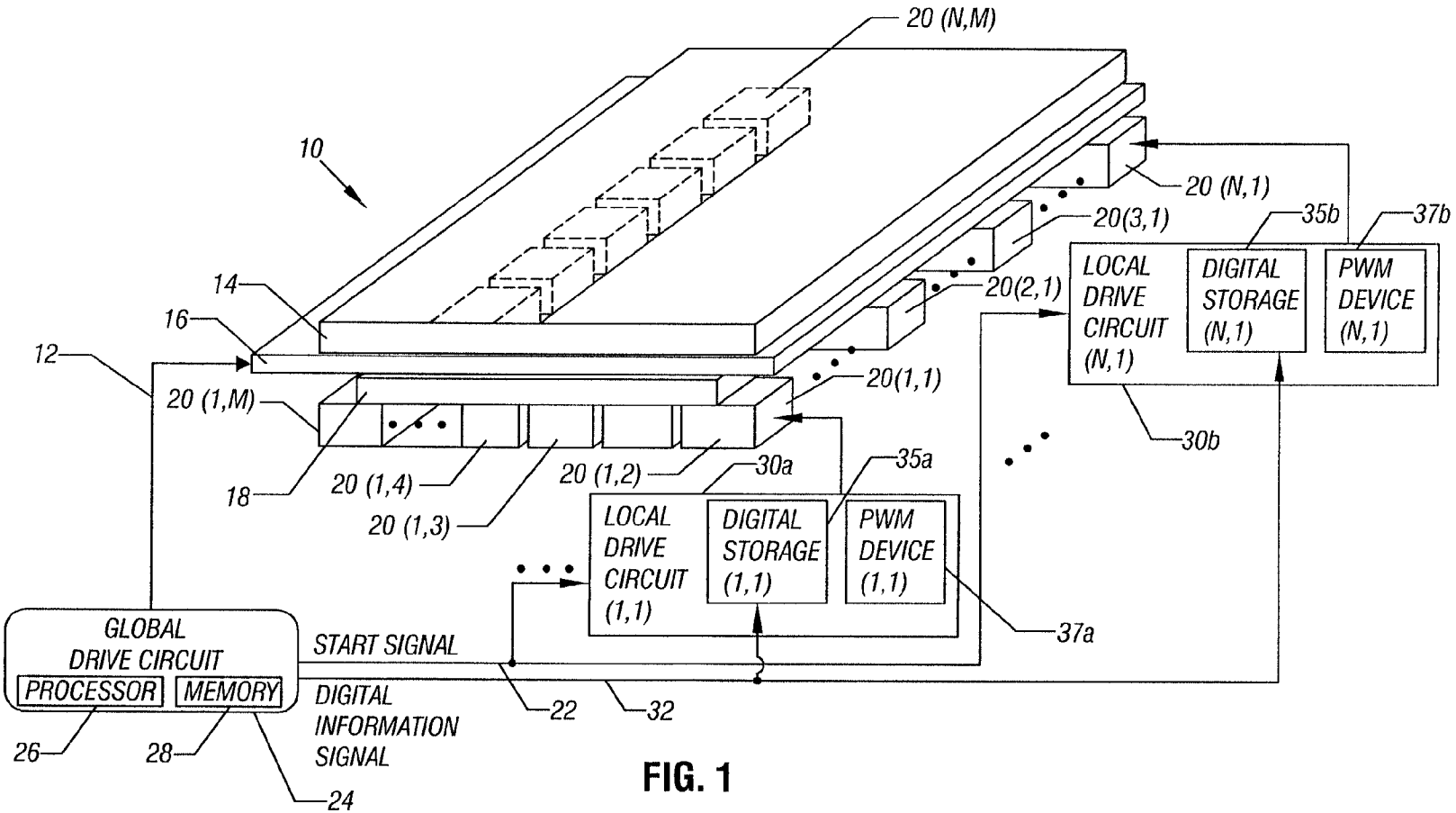
FIG. 1 is a schematic depiction of a display system according to an embodiment of the present invention.

A display system 10 (e.g., a liquid crystal display (display), such as a spatial light modulator (SLM)) shown in FIG. 1 includes a liquid crystal layer 18 according to an embodiment of the present invention. In one embodiment, the liquid crystal layer 18 may be sandwiched between a transparent top plate 16 and a plurality of pixel electrodes 20(1, 1) through 20(N, M), forming a pixel array comprising a plurality of display elements (e.g., pixels). In some embodiments, the top plate 16 may be made of a transparent conducting layer, such as indium tin oxide (ITO). Applying voltages across the liquid crystal layer 18 through the top plate 16 and the plurality of pixel electrodes 20(1, 1) through 20(N, M) enables driving of the liquid crystal layer 18 to produce different levels of intensity on the optical outputs at the plurality of display elements, i.e., pixels, allowing the display on the display system 10 to be altered. A glass layer 14 may be applied over the top plate 16. In one embodiment, the top plate 16 may be fabricated directly onto the glass layer 14.

A global drive circuit 24 may include a processor 26 to drive the display system and a memory 28 storing digital information including global digital information indicative of a common reference and local digital information indicative of an optical output from at least one display element, i.e., pixel. Based on a comparison of the global and local digital information, the display system 10 may determine a transition separating a first pulse interval and a second pulse interval in a modulated signal generated for at least one display element, i.e., pixel. Accordingly, from the modulated signal, the display element may be appropriately driven, providing the optical output based on the digital information.

In some embodiments, the global drive circuit 24 applies bias potentials 12 to the top plate 16. Additionally, the global drive circuit 24 provides a start signal 22 and a digital information signal 32 to a plurality of local drive circuits (1, 1) 30*a* through (N, 1) 30*b*, each local drive circuit may be associated with a different display element being formed by the corresponding pixel electrode of the plurality of pixel electrodes 20(1, 1) through 20(N, 1), respectively.

In one embodiment, a liquid crystal over silicon (LCOS) technology may be used to form the display elements of the pixel array. Liquid crystal devices formed using the LCOS technology may form large screen projection displays or smaller displays (using direct viewing rather then projection technology). Typically, the liquid crystal (LC) material is suspended over a thin passivation layer. A glass plate with an indium tin oxide (ITO) layer covers the liquid crystal, creating the liquid crystal unit sometimes called a cell. A silicon substrate may define a large number of pixels. Each pixel may include semiconductor transistor circuitry in one embodiment.

One technique in accordance with an embodiment of the present invention involves controllably driving the display system 10 using pulse-width modulation (PWM). More particularly, for driving the plurality of pixel electrodes 20(1,1) through 20(N, M), each display element may be coupled to a different local drive circuit of the plurality of local drive circuits (1, 1) 30*a* through (N, 1) 30*b*, as an example. To hold and/or store any digital information intended for a particular display element, a plurality of digital storage (1, 1) 35*a* through (N, 1) 35*b* may be provided, each digital storage may be associated with a different local drive circuit of the plurality of local drive circuits (1, 1) 30*a* through (N, 1) 30*b*, for example. Likewise, for generating a pulse width modulated waveform based on the respective digital information, a plurality of PWM devices (1, 1) 37*a* through (N, 1) 37*b* may be provided in order to drive a corresponding display element. In one case, each PWM device of the plurality of PWM devices (1, 1) 37*a* through (N, 1) 37*b* may be associated with a different local drive circuit of the plurality of local drive circuits (1, 1) 30*a* through (N, 1) 30*b*.

Consistent with one embodiment of the present invention, the global drive circuit 24 may receive video data input and may scan the pixel array in a row-by-row manner to drive each pixel electrode of the plurality of pixel electrodes 20(1,1) through 20(N, M).

Of course, the display system 10 may comprise any desired arrangement of one or more display elements. Examples of the display elements include spatial light modulator devices, emissive display elements, non-emissive display elements and current and/or voltage driven display elements.

Generally, a spatial light modulator (SLM) is a display device where a liquid crystal material (LC) is driven by circuitry located under each pixel. Of course, there are many reasonable pixel architectures for these devices, each of which have implications on how the LC material is driven. For example, an analog pixel might represent the color value of the pixel with a voltage that is stored on a capacitor under the pixel. This voltage can then directly drive the LC material to produce different levels of intensity on the optical output. Digital pixel architectures store the value under the pixel in a digital fashion. In this case, it is not possible to directly drive the LC material with the digital information, i.e., there needs to be some conversion to an analog form that the LC material can use. Therefore, pulse-width modulation (PWM) is utilized for generating color in an SLM device in one embodiment of the present invention. This enables pixel architectures that use pulse-width modulation to produce color in SLM devices. In this approach, the LC material is driven by a signal waveform whose "ON" time is a function of the desired color value.

More specifically, one embodiment of the display system 10 may be based on a digital system architecture that uses pulse-width modulation to produce color in spatial light modulator devices arranged in a matrix array comprising a plurality of digital pixels, each digital pixel including one or more sub-pixels. In one case, the matrix array may include a plurality of columns and a plurality of rows. The columns and rows may be driven by a separate global drive circuit, which may enable localized generation of a pulse width modulated voltage or current waveforms at a digital pixel level to drive the plurality of digital pixels. Alternatively, the plurality of digital pixels may be configured in any other useful or desirable arrangement.

In essence, to digitally drive the digital pixels according to the present invention, one operation may involve storing respective digital information received over the digital information signal 32 at each digital storage 37 associated with a different local drive circuit 30, for driving an associated pixel electrode 20 of the corresponding display element, for example. To indicate the lengths of the first and second pulse intervals forming the modulated signal, a particular timing providing a desired transition may be derived based on the digital information. In turn, the lengths of the first and second pulse intervals of the modulated signals may control the optical output of each display element within a refresh period.

For some embodiments, providing the local digital information may include dynamically receiving video data associated with each display element. However, receiving the video data, in one embodiment, includes programmably receiving at least one pixel value for each display element. The digital information may be programmably stored in at least one register associated with each display element. Then, for each display element, a duration of illumination, i.e., an "ON" time within the refresh period may be caused based on the length of the first pulse interval of the modulated signal.

When the display element receives the global and local digital information, the global digital information may be compared to the local digital information to determine a desired timing for a particular single transition in the modulated signal. As a result, this comparison may cause the particular single transition to occur in the modulated signal applied to the display element. Moreover, by varying the duration of application of the modulated signal to the display element, however, an optical output from the display element may be selectively adjusted based on this comparison. This selective adjustment feature may be utilized to compensate for a display nonlinearity of one or more display elements in one embodiment. To further nonlinearly modulate the optical output from the display element, the particular single transition may also be selectively delayed.

Figure 2:
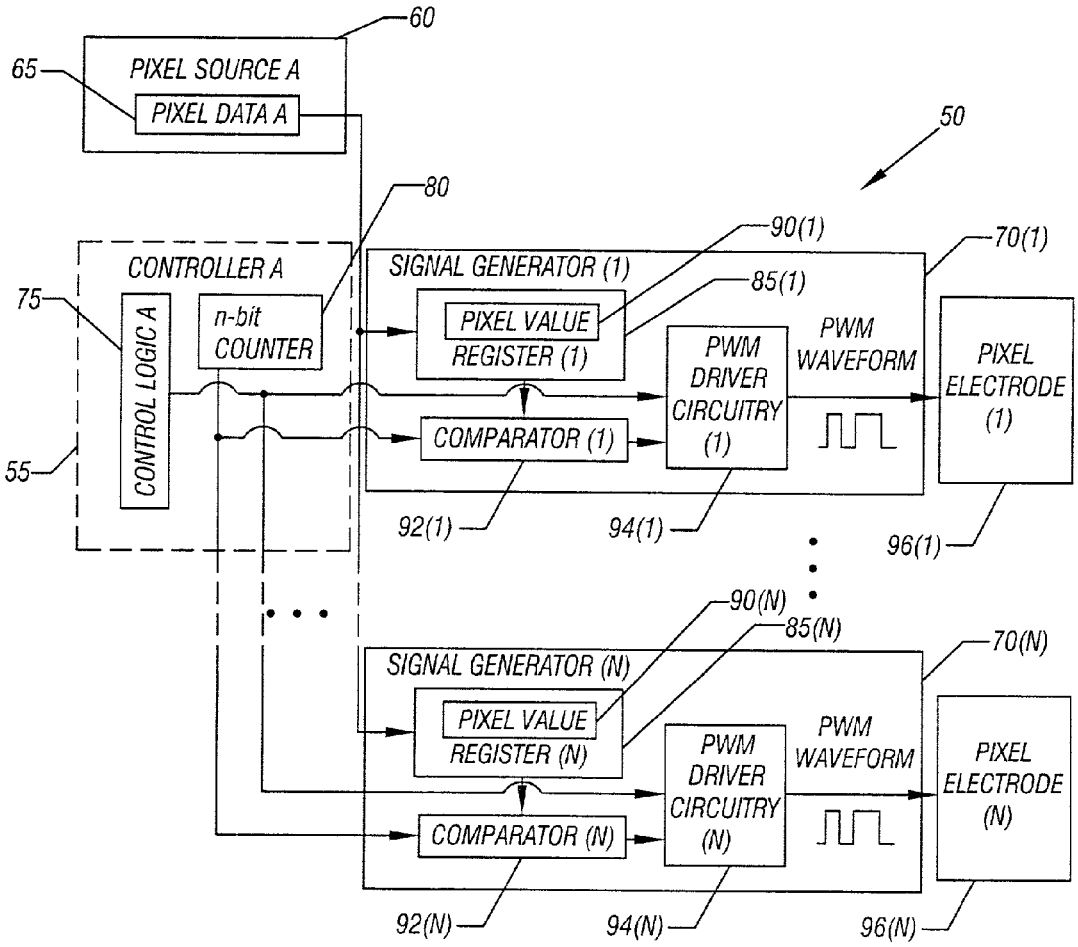
FIG. 2 is a block diagram of a linear spatial light modulator with digital storage employing linear pulse-width modulation (PWM), in accordance with one embodiment of the present invention.

Following the general architecture of the display system 10 of FIG. 1, a linear spatial light modulator (SLM) 50 shown in FIG. 2 includes a controller A 55 to controllably operate the linear SLM 50. For the purposes of storing digital information, the linear SLM 50 may further include a pixel source A 60. The pixel source A 60 stores pixel data A 65 comprising digital information that may include global digital information and local digital information in accordance with one embodiment of the present invention.

Although the scope of the present invention is not limited in this respect, pixel source A 60 may be a computer system, graphics processor, digital versatile disk (DVD) player, and/or a high definition television (HDTV) tuner. In addition, pixel source A 60 may not provide pixel data A 65 for all of the pixels in the display system 10. For example, the pixel source A 60 may simply provide the pixels that have changed since the last update since in some embodiments having appropriate storage for all the pixel values, it will ideally know the last value provided by the pixel source A 60.

The linear SLM 50 may further comprise a plurality of signal generators 70(1) through 70(N), each signal generator associated with at least one display element. Each signal generator 70 may be operably coupled to the controller A 55 for receiving respective digital information. When appropriately initialized, each signal generator 70 may determine a transition in a linearly pulse width modulated waveform based on the digital information to drive a different display element.

As shown in FIG. 2, in one embodiment, the controller A 55 may incorporate a control logic A 75 and a counter 80 (e.g., n-bit wide). The control logic A 75 may controllably operate each display element based on respective digital information. To this end, the counter 80 may provide global digital information indicative of a dynamically changing common reference, i.e., a count, to each display element.

In the illustrated embodiment, each signal generator 70 of the plurality of signal generators 70(1) through 70(N), may comprise a respective register 85 of a plurality of registers 85(1) through 85(N), a respective comparator 92 of a plurality of comparators 92(1) through 92(N), a respective PWM driver circuitry 94 of a plurality of PWM driver circuitry 94(1) through 94(N) to drive a corresponding pixel electrode 96 of a plurality of pixel electrodes 96(1) through 96(N). Each register 85 of the plurality of registers 85(1) through 85(N) may retain for further processing the associated digital information including a corresponding pixel value 90 of a plurality of pixel values 90(1) through 90(N) and/or the count to generate a corresponding linearly pulse width modulated waveform.

Figure 3:
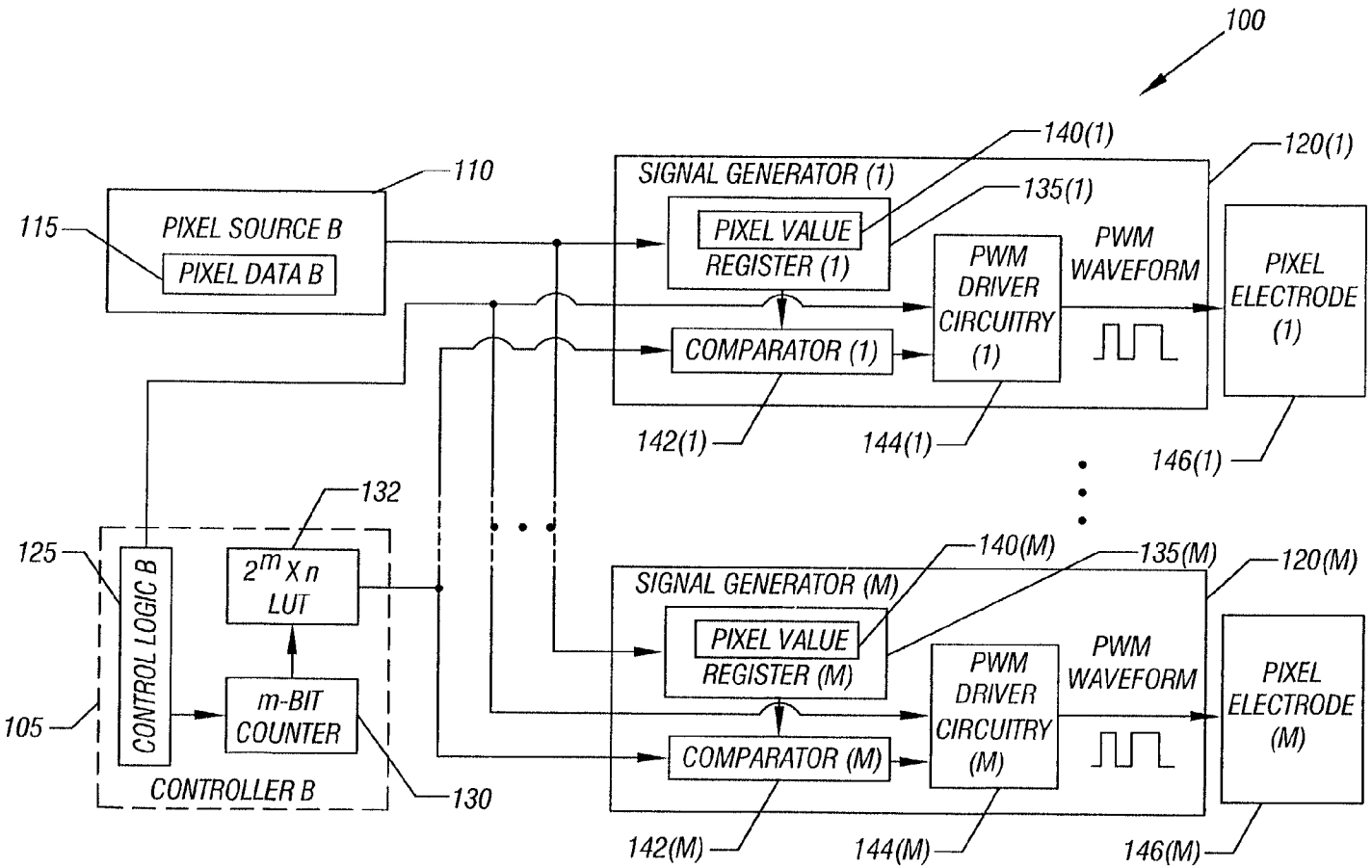
FIG. 3 is a block diagram of a nonlinear spatial light modulator with digital storage employing nonlinear pulse-width modulation, according to an alternate embodiment of the present invention.

Again, following the general architecture of the display system 10 of FIG. 1, a nonlinear spatial light modulator (SLM) 100 shown in FIG. 3 includes a controller B 105 to controllably operate the nonlinear SLM 100. The nonlinear SLM 100 may further include a pixel source B 110 for storing digital information. In accordance with one embodiment of the present invention, the pixel source B 110 stores pixel data B 115 comprising digital information that may include global digital information and local digital information associated with one or more display elements. The nonlinear SLM 100 may further comprise a plurality of signal generators 120(1) through 120(M) where each signal generator 120 may be operably coupled to the controller B 105 for receiving respective digital information for operating any associated display element. In operation, a single transition in a nonlinearly pulse width modulated waveform to drive a different display element, may be determined by each signal generator 120 based on the digital information provided and when appropriately initialized.

Referring to FIG. 3, in one embodiment, the controller B 105 may include a control logic B 125, a counter 130 (e.g., m-bit wide), and a look-up-table (LUT) 132. Each display element may be nonlinearly operated by the control logic B 125 based on respective digital information retrieved from the LUT 132. Here, again global digital information indicative of a dynamically changing common reference, i.e., a count, may be provided to each display element by the counter 130 via the LUT 132.

Each signal generator 120 of the plurality of signal generators 120(1) through 120(M), in the depicted embodiment, may comprise a respective register 135 of a plurality of registers 135(1) through 135(M), a respective comparator 142 of a plurality of comparators 142(1) through 142(M), a respective PWM driver circuitry 144 of a plurality of PWM driver circuitry 144(1) through 144(M) to drive a corresponding pixel electrode 146 of a plurality of pixel electrodes 146(1) through 146(M). Each register 135 of the plurality of registers 135(1) through 135(M) may store the associated digital information including a corresponding pixel value 140 of a plurality of pixel values 140(1) through 140(M) and the count to generate a corresponding nonlinearly pulse width modulated waveform. As described earlier in the context of the linear SLM 50 of FIG. 2, in a similar fashion, the corresponding nonlinearly pulse width modulated waveform may be formed for a corresponding pixel electrode 146 of a plurality of pixel electrodes 146(1) through 146(M).

Although the comparators 92,142 are shown in FIGS. 2 and 3 with a comparison function, other non-comparison functions that may be useful can be advantageously employed in some cases. One non-comparison function may include a decision function instead of a comparison function, in some embodiments. That is, in some embodiments, an input to the PWM driver circuitry 94,144 may be a Boolean function of the local and shared digital information. When operated, the Boolean function may provide a Boolean result, i.e., either "TRUE" or "FALSE." Likewise, an alternate element that maps the m-bit counter 130 output onto a different set of numbers may be advantageously used in some embodiments instead of the LUT 132 of FIG. 3. This is, in one embodiment, using such alternate element rather than the LUT 132; the control logic B 125 may nonlinearly operate each pixel electrode of the plurality of pixel electrodes 146(1) through 146(M).

Figure 4A:
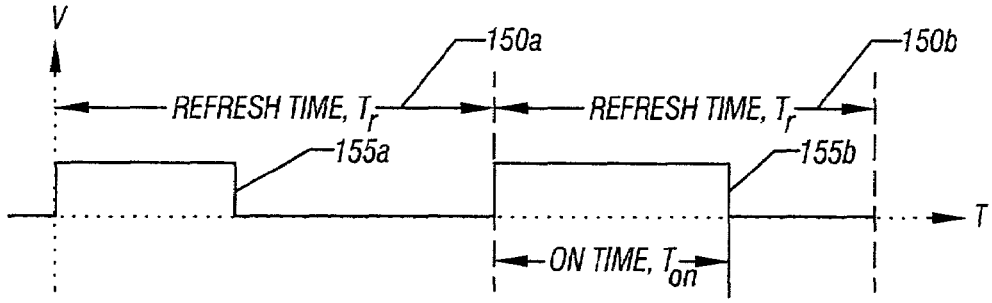
FIG. 4A is a hypothetical graph of applied voltage versus time for a spatial light modulator (SLM) in accordance with one embodiment of the present invention.

A hypothetical graph of an applied voltage versus time, i.e., a drive signal (e.g., a PWM waveform) is shown in FIG. 4A for a spatial light modulator in accordance with one embodiment of the present invention. Within a first refresh time period, $T_r$, 150*a*, the drive signal including a first transition 155*a* and during the next cycle, i.e., within a second refresh time period, $T_r$, 150*b*, the drive signal including a second transition 155*b* may be applied to the pixel electrode 96(1) of FIG. 2, for example. Each transition of the first and second transitions 155*a*, 155*b*, separates the drive signal in a first and second pulse intervals. The first pulse interval of the second refresh time period 150*b* is indicated as the "ON" time, $T_{on}$, as an example.

In some embodiments, the "ON" time, $T_{on}$, of the drive signal of FIG. 4A is a function, $f_{pwm}$, of the current pixel value, p, where $p \in [0, 2^n-1]$, n is the number of bits in a color component (typically 8 for some computer systems), $T_{on} \in [0, T_r]$, and $T_r$ is a constant refresh time. For example, if $f_{pwm}$, is linear, then $T_{on}$ may be given by the following equation:

$$T_{on} = f_{pwm}(p) = \frac{p}{2^n - 1} T_r \tag{1}$$

The first and second refresh time periods, i.e., $T_r$, 150*a* and 150*b*, may be determined depending upon the response time, i.e., $T_{resp}$, of the liquid crystal (LC) material along with an update rate, i.e., $T_{update}$, (e.g., the frame rate) of the content that the display system 10 (FIG. 1) may display when appropriately driven. Ideally, the refresh time periods, i.e., $T_r$, 150*a* and 50*b* may be devised to be shorter than that of the update rate, $T_{update}$, of the content, and the minimum "ON" time, minimum ($T_{on}$), may be devised to be larger than the response time, $T_{resp}$, of the LC material. However, $T_{on}$, may be time varying as a pixel value "p" may change over time.

It is often desirable to use a non-linear function for $f_{pwm}$ to match this function with other non-linear aspects of the display system 10. The function $f_{pwm}$ may be realized through a variety of conventional hardware. As the function $f_{pwn}$ is a function of the pixel value "p," some portion of this hardware may be locally disposed at each pixel in the display system 10, e.g., the linear SLM 50 of FIG. 2 or the nonlinear SLM 100 of FIG. 3. In any event, by advantageously moving as much of the functionality as possible into components that can be globally shared, i.e., within the global drive circuit 24 of FIG. 1, this hardware portion that is disposed locally at each pixel may be significantly reduced. As an example, FIG. 3 illustrates an SLM that uses this approach. In this example, the display system 10 employs the LUT 132 to generate the PWM function $f_{pwn}$ that is non-linear in nature.

Figure 4B:
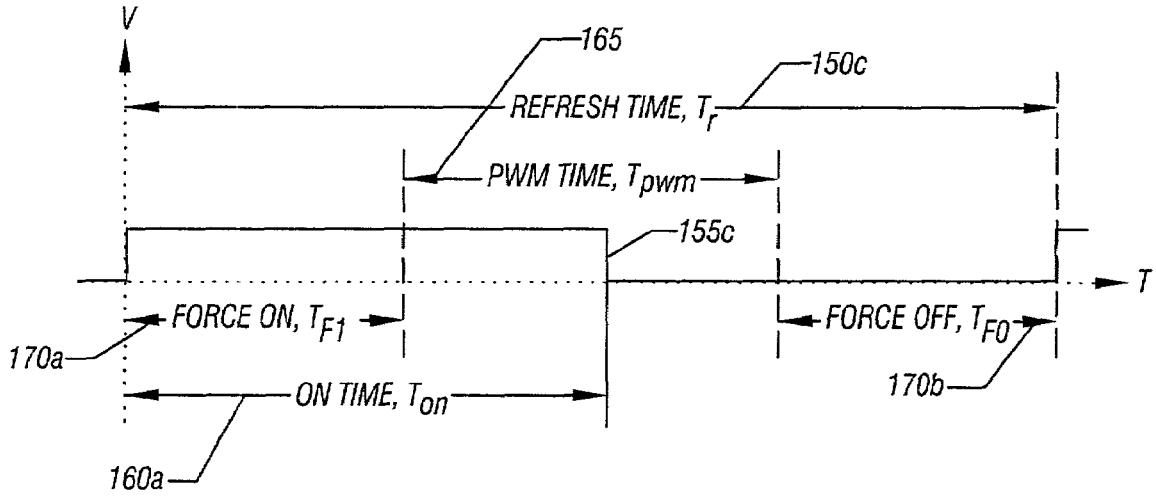
FIG. 4B is a hypothetical graph of adjusted applied voltage versus time for a SLM in accordance with another embodiment of the present invention.

Another useful feature according to one embodiment of the present invention enables the display system 10 to adjust the portion of the first and second refresh time periods, i.e., $T_r$, 150*a* and 150*b*, that is devoted to the PWM waveform. By adding additional delay, the LCD system 10 can produce an adjusted PWM waveform shown in FIG. 4B, which shows another hypothetical graph of the applied voltage versus time that is selectively adjusted to provide an adjusted drive signal as shown for a spatial light modulator according to one embodiment of the present invention. During a refresh time period, $T_r$, 150*c* the applied voltage may be adjusted to form the adjusted drive signal to include a delayed transition 155*c*, providing an adjusted "ON" time, $T_{on}$, 160*a*.

As shown in FIGS. 2 and 3, in one embodiment, either one of the controllers A 55 or B 105 may operate as follows. In step 1, either one of the control logics A 75 or B 125 may present a "start" signal (e.g., the start signal 22 of FIG. 1) to each PWM driver circuitry (N) 94 or (M) 144, which may generate a corresponding PWM waveform for the attached pixel at each pixel electrode of the pixel electrodes (N) 96 or (M) 146. In step 2, each PWM driver circuitry (N) 94, or (M) 144 in each pixel turns its output "ON" in response to the "start" signal.

The n-bit counter 80 (where "n" may be the number of bits in a color component) may begin counting up from zero at a frequency given by $2^n/T_r$ in step 3. In step 4, each pixel monitors the counter value using comparator circuits (N) 92 that compares two n-bit values, i.e., the counter and pixel values "c," "p" for equality. An n-bit register (N) 85 may hold the current pixel value for each pixel. When a pixel finds that the counter value "c" is equal to its pixel value "p," the PWM driver circuitry (N) 94 turns its output "OFF." This process repeats in an iterative manner by repetitively going back to the step 1 based on a particular implementation.

Forced delays may be introduced in some embodiments to generate an adjusted PWM waveform, for example, having a time period indicated as $T_{pwm}$ 165. In particular, a first force "ON" time, $T_{f1}$, 170*a*, and a second force "OFF" time, $T_{f0}$, 170*b*, may be introduced in one embodiment. Adding additional delay between the steps 2 and 3 creates the first force "ON" time, $T_{f1}$. Adding additional delay between the steps 3 and 4 creates the second force "OFF" time, $T_{f0}$. Although adding these times can bound the minimum and maximum portion of the first and second refresh time periods, i.e., $T_r$ 150*a* and 150*b*, that is spent within the PWM waveform during the "ON" state, however, a new PWM waveform with a single transition may still be generated accordingly.

At each pixel, the output waveform of the PWM driver circuitry (N) 94 (which drives the LC material) is "ON" for "p" counter increments ( is the pixel value). Because there are $2^n$ clock ticks each refresh time, $T_r$, this generates a linear PWM waveform given by Equation (1). The logic necessary to load video data (e.g. pixel values) into the pixel array is not shown. However, if the video data, i.e., a pixel value load occurs asynchronously to the PWM behavior, either one of the control logics A 75 may direct the PWM driver circuitry (N) 94 to turn "OFF" its output when writing a value less than the current counter value into any pixel. With appropriate design, the logic to perform this additional comparison can be located outside of the pixel array since this operation does not depend on a pixel value.

Since transfer curves for most LC material are non-linear, it is desirable to be able to generate non-linear PWM functions. FIG. 3 illustrates a modified version of the system shown in FIG. 2 that allows for non-linear PWM functions, $f_{pwm}$. In this figure, the counter value "c" that is provided to the pixels comes from the look-up-table (LUT) 132. The values in the LUT 132 may be monotonically increasing and in the interval [0, $2^n-1$], for example. The LUT 132 is indexed by the output of the m-bit counter 130 that operates at a higher frequency, $2^m/T_r$, than the n-bit counter 80 from FIG. 2 (i.e., m>n).

In this way, the LUT 132 in conjunction with the m-bit counter 130 may allow the nonlinear SLM 100 to quantize the refresh interval into $2^m$ intervals (where m>n) so that it can provide a fine control over the duration of the "ON" times for a PWM waveform according to one embodiment. Accordingly, the embodiment in FIG. 3 may add non-linearity by chopping up the refresh time into smaller chunks ($2^m$ chunks, specifically) and then use the LUT 132 to map the smaller chunks onto pixel values. For example, at count "i," all pixels with value "p" (i.e., LUT[i]=p) may be turned "OFF." By appropriately programming the LUT 132, non-linear PWM functions may be suitably furnished. Likewise, using the LUT 132, in some embodiments, forced delays may also be introduced by programming the transitions for pixel values to occur after the m-bit counter 130 reaches a value that corresponds to the force "ON" time and by making sure that all pixel values transition before the force "OFF" time.

By selecting the values in the LUT 132, the time that a given n-bit value is presented to the pixels may be suitably varied (note that in the linear case, all n-bit values are presented to the pixel for the same duration). Instead of varying the m-bit counter 130 signal over time as is done in FIG. 3, it is also possible to allow for non-linear PWM functions by changing the rate at which the counter 130 circuit is clocked by dynamically changing this clocking signal with a voltage-controlled oscillator. By allowing the ability to program the values in the LUT 132 dynamically, the PWM function, $f_{pwm}$ may be tuned to a specific transfer curve associated with the LC material that, e.g., the display system 10 of FIG. 1 may use.

Figure 5:
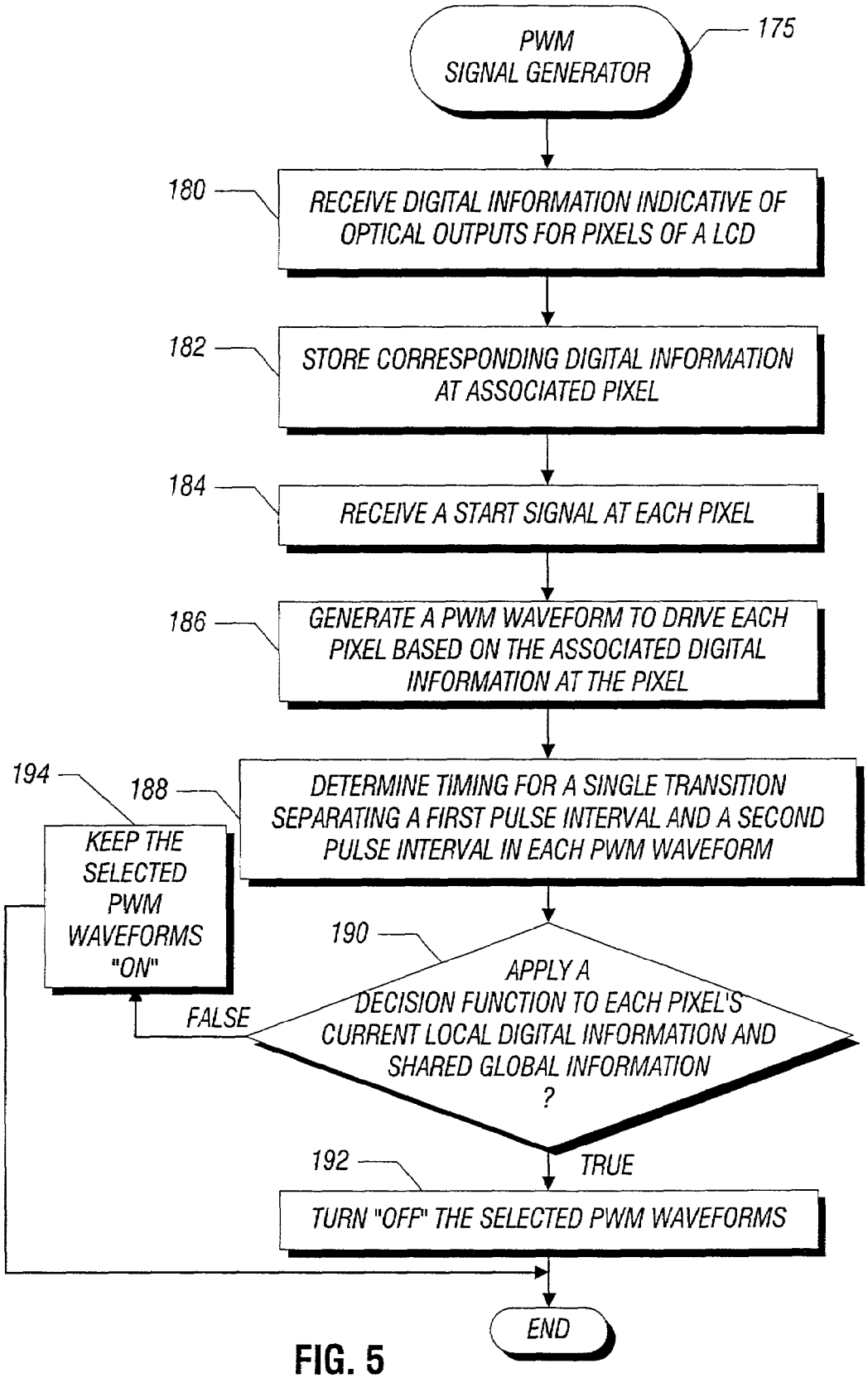
FIG. 5 is a flow chart of a PWM signal generator to digitally drive pixels from pulse width modulated waveforms in accordance with one embodiment of the present invention.

A PWM signal generator 175 (i.e., either a combination of all the plurality of the signal generators 70(1) through 70(N) of FIG. 2 or a combination of all the plurality of the signal generators 120(1) through 120(N) of FIG. 3) is shown in FIG. 5 to digitally drive pixels from pulse width modulated waveforms in accordance with one embodiment of the present invention. While the scope of the present invention is not so limited in this respect, a single pass through the PWM signal generator 175 for one refresh period or interval is illustrated in FIG. 5, as an example.

Each register 85 (FIG. 2) of the plurality of registers 85(1) through 85(N) may dynamically receive video data associated with a different display element to cause the "ON" time within the refresh period based on the corresponding linearly pulse width modulated waveform at block 180. Corresponding digital information including video data having a corresponding pixel value may be programmably received at each display element. More specifically, each register 85 of the plurality of registers 85(1) through 85(N) may store the corresponding pixel value 90 of the plurality of pixel values 90(1) through 90(N) at block 182.

At each pixel electrode 96 (FIG. 2) of the plurality of the pixel electrodes 96(1) through 96(N), the start signal 22 (FIG. 1) may be received in block 184. Each PWM driver circuitry 94 (FIG. 2) of the plurality of PWM driver circuitry 94(1) through 94(N) may form a respective pulse width modulated waveform based on associated digital information at the pixel at block 186. According to one embodiment, each signal generator 70 (FIG. 2) of the plurality of signal generators 70(1) through 70(N) may determine the timing for a single transition to form the corresponding pulse width modulated waveform based on the current digital information at block 188.

When provided, the single transitions of the corresponding pulse width modulated waveforms may control the optical outputs from the associated display elements within a refresh period. Additionally, each signal generator 70 of the plurality of signal generators 70(1) through 70(N) may drive an associated display element from the corresponding pulse width modulated waveform, providing a dynamically changing optical output based on the current digital information made available.

A check at the diamond 190 may provide a desired transition in each pulse width modulated waveform driving the associated display element. Here, a decision function may be applied to each pixel's current local digital information and shared global information. The decision function may return a result, such as a Boolean result (i.e., TRUE, or FALSE). In one embodiment, each comparator 92 (FIG. 2) of the plurality of comparators 92(1) through 92(N) may compare the global digital information, i.e., the count with the local digital information. If determined to be "TRUE," the pulse width modulated waveforms may be selectively turned "OFF" at block 192 (e.g., a subset of all the pixels may change their state from "ON" to "OFF"). In some embodiments, however, all the pixels may change their state at the same time. Conversely, if determined to be "FALSE," the pulse width modulated waveforms may be selectively kept "ON" at block 194. Again, for example, a subset of all the pixels may change their state from "OFF" to "ON." Alternatively, in one case, all the pixels may concurrently change their state from "OFF" to "ON."

Figure 6:
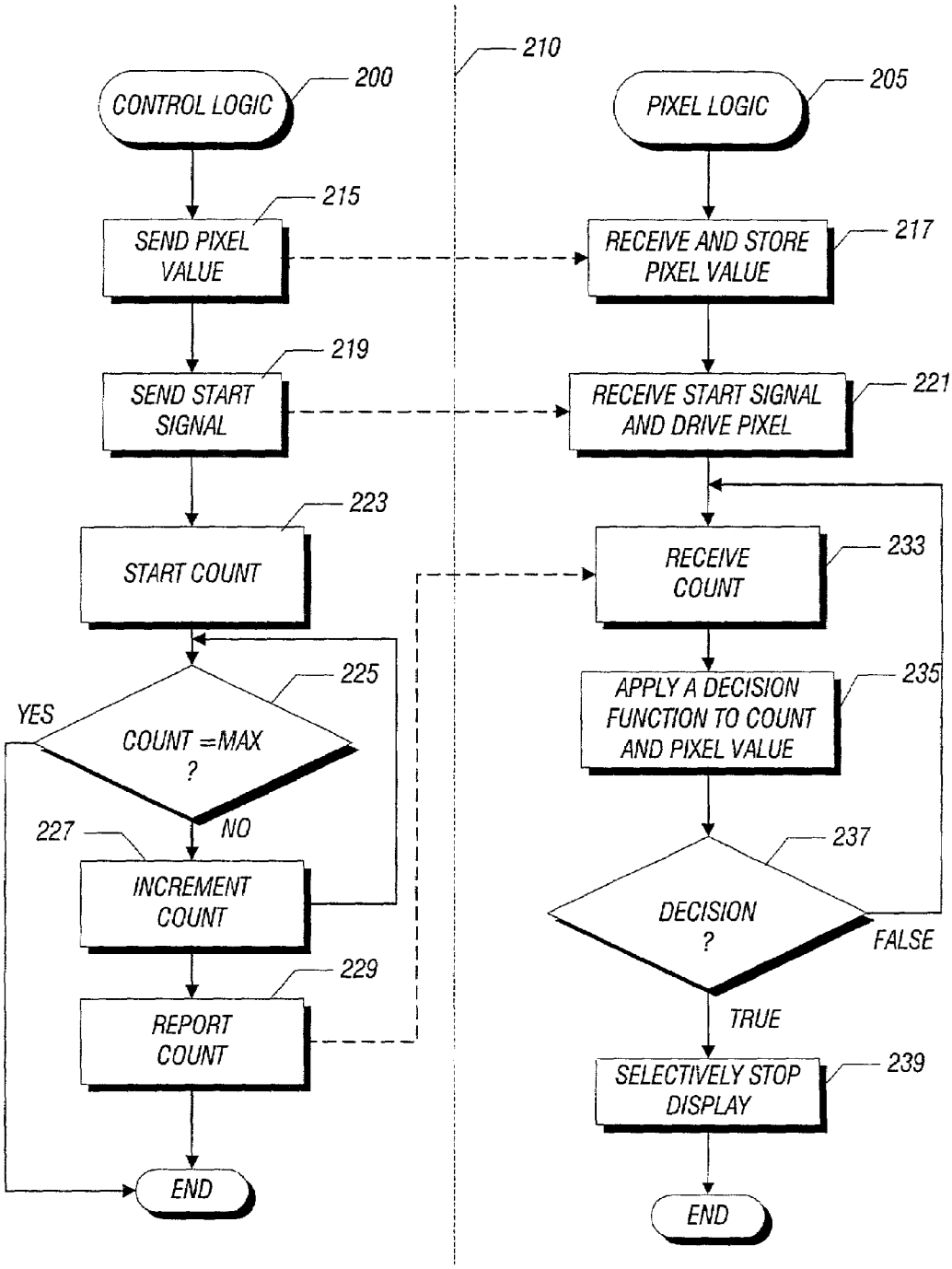
FIG. 6 is a flow chart of a control logic and a pixel logic consistent with one embodiment of the present invention.

To digitally drive pixels from pulse width modulated waveforms, a control logic 200 (e.g., for the global drive circuit 24 of FIG. 1) and a pixel logic 205 (e.g., for each local drive circuit of the plurality of local drive circuits (1, 1) 30*a* through (N, 1) 30*b* of FIG. 1) consistent with one embodiment of the present invention are shown in FIG. 6. For the ease of the presentation, a hypothetical dotted line 210 functionally distinguishes the control logic 200 from the pixel logic 205. According to one embodiment, to provide digital information entails sending a pixel value to each display element at block 215 using the control logic 200. A corresponding pixel value may be received at each display element for storage in a register located at each display element at block 217. At block 219, the start signal 22 (FIG. 1) may also be sent from the control logic 200 to each display element.

Specifically, to drive the display element, e.g., the pixel, the start signal 22 (FIG. 1) may be properly received at the pixel logic 205 at block 221. A count may be started by the control logic 200 block 223 for iteratively providing multiple count values to the pixel logic 205. A check at diamond 225 may compare the current count value "COUNT" to a predefined value, for example, a maximum value "MAX." If the "COUNT" is determined to be same as that the "MAX," a first refresh interval is over and another pass may begin. Conversely, a looping sequence occurs by first incrementing the "COUNT" at block 227, and then returning for another comparison to the diamond 225. However, in accordance with one embodiment, each incremented "COUNT" may be iteratively reported back to the pixel logic 205 at block 229 until the "COUNT" reaches the "MAX." In this way, cooperatively the control logic 200 and pixel logic 205 go through a single pass during a single refresh period. This routine may be repeated based on a particular application, desiring a display over multiple refresh periods.

By starting the count in block 223 for subsequent reporting thereof to each display element, and responsive to the start signal 22 (FIG. 1) and the count at block 233 , a modulated signal may be generated accordingly for each display element. At block 235, a decision function may operate on the count and the pixel value. In one case, the decision function may be a Boolean function, returning either a "TRUE" or a "FALSE" value based on the count and pixel value. In doing so, the pixel value may be compared to the count at the block 235; the timing of a respective single transition may be determined to drive each display element in one embodiment.

Based on a determination at block 237, the pixel logic 205 may provide a result, i.e., either "TRUE" or "FALSE." In this way, based on the determination for timing of a prospective single transition for each display element, a single transition may be suitably caused in each modulated signal at the block 237. When the global and local digital information, i.e., the pixel value and the count are substantially equal, one transition may be caused from an "ON" logic state to an "OFF" logic state in the modulated signal, as an example, selectively stopping the display at block 239. On the other hand, another transition may be caused from an "OFF" logic state to an "ON" logic state in the modulated signal when the global and local digital information are different, iterating back to receive a new count at the block 233.

Thus, one embodiment of the present invention locally generates a PWM waveform to digitally drive a pixel. The PWM waveform includes a single "ON" pulse rather than the addition of non-overlapping "ON" pulses (i.e., there is a single "ON" to "OFF" transition in the PWM waveform each refresh period). Moreover, the PWM waveform may be a non-linear function of the pixel value. In addition, the PWM waveform may be programmed to match the transfer characteristics of the LC material.

Such a single "ON" pulse based technique may afford several advantages in one embodiment of the present invention. For instance, by providing a single "ON" pulse, a display device or display system architecture (e.g., digital pixel architectures for a digital SLM device) may better control the LC material being driven. In contrast, this type of control may be significantly lacking in some situations with approaches that add up multiple non-overlapping pulses to build the PWM waveform. By allowing total programmability of the PWM waveform, in one embodiment, the display device or display system architecture may be relatively better tuned to a particular LC material than a system that simply uses a fixed waveform, as this scheme may allow the duty cycle of the fixed waveform to vary either as a linear or nonlinear function of pixel value with a single "ON" pulse.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method, comprising:

providing digital information including global digital information indicative of a common reference and local digital information indicative of an optical output from at least one display element; and determining a transition separating a first pulse interval and a second pulse interval in a modulated signal based on the digital information.

2. The method of claim 1, including driving said at least one display element from the modulated signal to provide the optical output based on said digital information.

3. The method of claim 2, including:

storing said digital information at said at least one display element;

deriving the timing of said transition to indicate the lengths of said first and second pulse intervals forming the modulated signal based on said digital information; and controlling the optical output of the at least one display element based on said lengths of said first and second pulse intervals of the modulated signal within a refresh period.

4. The method of claim 3, wherein providing said local digital information including:

dynamically receiving video data associated with the at least one display element; and causing a duration of illumination within said refresh period for the at least one display element based on the length of the first pulse interval of the modulated signal.

5. The method of claim 4, wherein receiving said video data includes programmably receiving at least one pixel value corresponding to the at least one display element.

6. The method of claim 3, including:

programmably storing said digital information in at least one register associated with the at least one display element;

varying a duration of application of the modulated signal to the at least one display element based on said digital information;

selectively adjusting the optical output based on said duration of application of the modulated signal to compensate for a display nonlinearity for the at least one display element; and selectively delaying said transition based on said digital information to nonlinearly modulate the optical output from the at least one display element.

7. The method of claim 3, including:

receiving said global and local digital information;

using said global and local digital information to determine the lengths of said first and second pulse intervals; and causing said transition in the modulated signal to the at least one display element based on the lengths of said first and second pulse intervals.

8. The method of claim 3, wherein providing digital information includes sending at least one pixel value to said at least one display element and said method further including:

receiving said at least one pixel value to store in at least one register at said at least one display element;

sending a start signal to said at least one display element;

in response to the start signal at said at least one display element, initiating the modulated signal to drive said at least one display element;

incrementing a count and reporting the count to said at least one display element;

in response to said count at said at least one register of said at least one display element, comparing said at least one pixel value to said count to determine the timing of the transition; and causing said transition in the modulated signal for the at least one display element based on the timing of said transition.

9. The method of claim 1, including causing said transition from an "ON" logic state to an "OFF" logic state in the modulated signal when said global and local digital information meet a first predefined criterion.

10. The method of claim 9, including causing said transition from an "OFF" logic state to an "ON" logic state in the modulated signal when said global and local digital information meet a second predefined criterion being substantially opposite that the first predefined criterion.

11. An apparatus, comprising:

at least one display element;

a controller to provide digital information including global digital information indicative of a common reference and local digital information indicative of an optical output from the at least one display element; and a signal generator associated with the at least one display element operably coupled to said controller to receive the digital information and to determine a transition separating a first pulse interval and a second pulse interval in a modulated signal based on the digital information.

12. The apparatus of claim 11, wherein said signal generator to drive the at least one display element from the modulated signal to provide the optical output based on a comparison of the global and local digital information.

13. The apparatus of claim 12, further comprising:

a pixel source operably coupled to the signal generator to receive said digital information, said signal generator to:

derive the timing of said transition to indicate the lengths of said first and second pulse intervals forming the modulated signal based on said digital information; and control the optical output for the at least one display element based on said lengths of said first and second pulse intervals of the modulated signal within a refresh period.

14. The apparatus of claim 13, wherein said pixel source dynamically receives video data associated with the at least one display element to cause a duration of illumination within said refresh period for the at least one display element based on the length of the first pulse interval of the modulated signal.

15. The apparatus of claim 13, wherein said at least one display element includes a plurality of display elements forming an array of display elements in a liquid crystal display.

16. The apparatus of claim 15, wherein said liquid crystal display includes a spatial light modulator.

17. The apparatus of claim 13, wherein said controller includes:

a control logic to controllably operate the at least one display element based on said digital information; and a counter to provide global digital information indicative of a dynamically changing common reference for said at least one display element.

18. The apparatus of claim 17, wherein said signal generator includes a device to use said global digital information with said local digital information to provide said transition in the modulated signal driving the at least one display element.

19. The apparatus of claim 18, wherein said each signal generator includes an associated pulse width modulator to form said modulated signal based on said transition, said associated pulse width modulator to:

programmably receive said digital information including video data including a pixel value;

store said pixel value;

selectively delay the transition based on said pixel value; and cause the transition in said modulated signal from a first logic state to a second logic state to nonlinearly modulate the optical output from the at least one display element.

20. The apparatus of claim 19, wherein said pixel source includes at least one register to store said pixel value.

21. A processor-based system, comprising:

a pixel array including a first and second pixel;

at least two first circuits, each associated with a different pixel of said pixel array; and a second circuit to supply digital information including global digital information indicative of a common reference and local digital information indicative of a pixel output to each first circuit to determine a transition separating a first pulse interval and a second pulse interval in a modulated signal based on the digital information.

22. The processor-based system of claim 21, wherein said each first circuit of the at least two first circuits comprising:

a waveform forming device to generate the modulated signal through pulse-width modulation that drives said different pixel of the pixel array causing the pixel output based on a comparison of the global and local digital information.

23. The processor-based system of claim 22, wherein said each first circuit of the at least two first circuits further comprising:

a digital pixel source operably coupled to the waveform forming device to receive said digital information, said each first circuit to:

derive the timing of the transition to indicate the lengths of said first and second pulse intervals based on said digital information; and control the pixel output from a pixel of the pixel array based on the modulated signal within a refresh period.

24. The processor-based system of claim 23, wherein said each digital pixel source to dynamically receive corresponding video data associated with a pixel to cause a duration of illumination for said pixel based on the length of the first pulse interval of the modulated signal within said refresh period.

25. The processor-based system of claim 23, wherein said pixel array includes a liquid crystal display.

26. The processor-based system of claim 25, wherein said liquid crystal display includes a spatial light modulator.

27. The processor-based system of claim 23, wherein said second circuit includes:

a control logic to controllably operate each pixel of said pixel array based on said digital information; and a counter to provide a count in said common reference of said global digital information.

28. The processor-based system of claim 27, wherein said each first circuit of the at least two first circuits includes a device to use said local digital information with the global digital information to provide the transition in the modulated signal for an associated pixel of said pixel array.

29. The processor-based system of claim 28, wherein said each first circuit of the at least two first circuits to:

programmably receive said video data including at least one pixel value associated with the associated pixel of said pixel array;

store said each pixel value;

selectively delay the transition based on said each pixel value; and cause the transition in said modulated signal from a first logic state to a second logic state to nonlinearly modulate the pixel output of the associated pixel of said pixel array.

30. The processor-based system of claim 23, wherein said each digital pixel source includes at least one register to store said digital information associated with a pixel of said pixel array.

* * * * *